US008632371B1

(12) United States Patent
Ramsey

(10) Patent No.: US 8,632,371 B1
(45) Date of Patent: Jan. 21, 2014

(54) KAYAK PADDLE

(71) Applicant: Derek Ramsey, North Easton, MA (US)

(72) Inventor: Derek Ramsey, North Easton, MA (US)

( * ) Notice: Subject to any disclaimer, the term of this patent is extended or adjusted under 35 U.S.C. 154(b) by 0 days.

(21) Appl. No.: 13/685,872

(22) Filed: Nov. 27, 2012

(51) Int. Cl.
*B63H 16/04* (2006.01)

(52) U.S. Cl.
USPC ..... 440/101

(58) Field of Classification Search
USPC ..... 440/101, 102
See application file for complete search history.

(56) References Cited

U.S. PATENT DOCUMENTS

| | | | | | |
|---|---|---|---|---|---|
| 3,030,641 | A * | 4/1962 | Ake | 416/71 |
| 4,622,017 | A * | 11/1986 | McGraw | 440/101 |
| 4,820,216 | A * | 4/1989 | Masters | 440/101 |
| 4,926,772 | A * | 5/1990 | Bright | 114/39.12 |
| D320,375 | S * | 10/1991 | Bruce | D12/215 |
| 5,795,201 | A * | 8/1998 | Tibbetts | 440/101 |
| 6,022,255 | A | 2/2000 | Lukanovich | |
| 6,027,386 | A | 2/2000 | Hains et al. | |
| 6,261,141 | B1 * | 7/2001 | Heap | 440/101 |
| 6,328,617 | B1 * | 12/2001 | Gunnell | 440/101 |
| 6,796,862 | B1 * | 9/2004 | Abbenhouse et al. | 440/101 |
| 7,311,573 | B1 | 12/2007 | Dillenschneider | |
| D578,054 | S * | 10/2008 | Peng | D12/215 |
| D578,055 | S * | 10/2008 | Halm | D12/215 |
| D632,629 | S | 2/2011 | Bradley | |
| 2008/0057802 | A1 * | 3/2008 | Wilkinson | 440/101 |
| 2011/0011432 | A1 * | 1/2011 | Yakos et al. | 135/66 |

* cited by examiner

*Primary Examiner* — Lars A Olson
*Assistant Examiner* — Jovon Hayes
(74) *Attorney, Agent, or Firm* — Kyle Fletcher

(57) ABSTRACT

The kayak paddle is a transformative device capable of becoming an oar or a paddleboard paddle. The kayak paddle includes a first paddle blade that includes a notched end on a distal end, which is characterized for use in pushing off of a stationary object. The first paddle blade also includes a pull notch that is oriented opposable of the notched end, and is suited for pulling action with respect to a stationary object. An extension shaft and a second shaft member are included in order to transform the kayak paddle to a paddleboard paddle. A second paddle blade is provided on the second shaft member and features a finger grip opening that enables an end user to articulate the device as a paddleboard paddle.

6 Claims, 5 Drawing Sheets

KAYAK PADDLE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of paddle and oars, more specifically, a kayak paddle that is convertible into an oar or a paddle, and which is adjustable in length.

When paddling different watercraft there is typically different hand-held paddles that are specific to a respective type of watercraft. Traditional paddies and oars are limited in application, and often do not provide adaptation to different needs and uses. The device of the present application offers a new and novel paddle that is able to transform from a kayak paddle to an oar that may be used in a canoe, and then to a paddleboard paddle. Moreover, the device of the present application includes additional features beyond that of merely paddling, but providing notches and grooves to enable pushing and pulling with respect to stationary objects that are typically associated with maneuvering around a body of water.

B. Discussion of the Prior Art

As will be discussed immediately below, no prior art discloses a kayak paddle that is able to convert to an oar that may be used in a canoe or that is also able to convert to a paddleboard paddle; wherein the kayak paddle includes a first paddle blade that includes a notched end that is ideal for pushing off from a stationary object, and is located on a distal end of the respective paddle blade; wherein the first paddle blade includes a pull notch that is located at a shoulder of the paddle blade that is opposite of the distal end; wherein the first paddle blade features a shaft member with an indexed ferrule and tether that are located at an opposing end of the shaft member with respect to the first paddle blade; wherein the invention includes an extension shaft and a second shaft member that can connect to form a paddleboard paddle; wherein the second shaft member includes a second paddle blade that includes a finger grip opening therein; wherein, the second shaft member includes 1" graduations along a length, which enable the end user to determine water depths associated with a full paddleboard paddle length.

The Yakos et al. Patent Application Publication (U.S. Pub. No. 2011/0011432) discloses a trekking pole that is convertible into a two handed double bladed kayaking paddle and into a single bladed paddle. However, the ability to transform the single bladed paddle to a two handed double bladed paddle does not include graduations, finger grip opening, or different notches specific to pushing or pulling with respect to stationary objects.

The Lukanovich Patent (U.S. Pat. No. 6,022,225) discloses a kayak paddle that may be convertible to a canoe paddle. However, the paddle does not transform from a kayak paddle to an oar or to a paddleboard paddle, and which includes notches on a paddle blade for different capabilities.

The Hains et al. Patent (U.S. Pat. No. 6,027,386) discloses a combination paddle and water syringe. However, the paddle and water syringe is not able to transform to an oar, a kayak paddle, or a paddleboard paddle.

The Tibbetts Patent (U.S. Pat. No. 5,795,201) discloses a one-handed canoe paddle comprised of a blade portion, a hand grip portion, and an arm cuff portion. However, the paddle does not include additional members that transform the oar to a kayak paddle or to a paddleboard paddle.

The Dillenschneider Patent (U.S. Pat. No. 7,311,573) discloses a water craft paddle device for one-arm use. Again, the paddle device is unable to transform to an oar or a paddleboard paddle, and also does not include the notches on a paddle blade to enable pulling or pushing with stationary objects.

The Bradley Patent (U.S. Pat. No. Des. 632, 629) illustrates an ornamental design for an extendible handled paddle for paddleboarding. However, the ornamental design does not include all of the features attributed with the device of the present application.

The Eversole Patent (U.S. Pat. No. Des. 364,598) illustrates an ornamental design for a modular boat oar. Again, the design of the boat oar fails to depict all applicable features of the device at bar.

While the above-described devices fulfill their respective and particular objects and requirements, they do not describe a kayak paddle that is able to convert to an oar that may be used in a canoe or that is also able to convert to a paddleboard paddle; wherein the kayak paddle includes a first paddle blade that includes a notched end that is ideal for pushing off from a stationary object, and is located on a distal end of the respective paddle blade; wherein the first paddle blade includes a pull notch that is located at a shoulder of the paddle blade that is opposite of the distal end; wherein the first paddle blade features a shaft member with an indexed ferrule and tether that are located at an opposing end of the shaft member with respect to the first paddle blade; wherein the invention includes an extension shaft and a second shaft member that can connect to form a paddleboard paddle; wherein the second shaft member includes a second paddle blade that includes a finger grip opening therein; wherein the second shaft member includes 1" graduations along a length, which enable an angler to determine a length of a caught fish or to determine water depths associated with a full paddleboard paddle length. In this regard, the kayak paddle departs from the conventional concepts and designs of the prior art.

SUMMARY OF THE INVENTION

The kayak paddle is a transformative device capable of becoming an oar or a paddleboard paddle. The kayak paddle includes a first paddle blade that includes a notched end on a distal end, which is characterized for use in pushing off of a stationary object. The first paddle blade also includes a pull notch that is oriented opposable of the notched and, and is suited for pulling action with respect to a stationary object. An extension shaft and a second shaft member are included in order to transform the kayak paddle to a paddleboard paddle. A second paddle blade is provided on the second shaft member and features a finger grip opening that enables an end user to articulate the device as a paddleboard paddle. The second shaft member includes 1" graduations that may be used by an angler to measure a length of a caught fish or to indicate water depth associated with a full paddleboard paddle length.

It is an object of the invention to provide a device that can convert from an oar to a kayak paddle and to a paddleboard paddle.

A further object of the invention is to provide a first paddle member with notches that are specifically designed to push off of or pull towards a stationary object.

An even further object of the invention is to provide an extension shaft and second shaft member that enable conversion of the device to a paddleboard paddle or to a kayak paddle.

Another object of the invention is to.

These together with additional objects, features and advantages of the kayak paddle will be readily apparent to those of ordinary skill in the art upon reading the following detailed description of presently preferred, but nonetheless illustrative, embodiments of the kayak paddle when taken in conjunction with the accompanying drawings.

In this respect, before explaining the current embodiments of the kayak paddle in detail, it is to be understood that the kayak paddle is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the kayak paddle.

It is therefore important that the claims be regarded as including such equivalent construction insofar as they do not depart from the spirit and scope of the kayak paddle. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-8. A kayak paddle 100 (hereinafter invention) includes a first paddle blade 101 that has the shape and size of a typical oar or blade associated with a kayak, but is further defined with a notched end 102 that is located on a distal end of the first paddle blade 101, and which is specifically included to provide a location where an end user is able to push the first paddle blade 101 against a stationary object 150.

Figure 1:
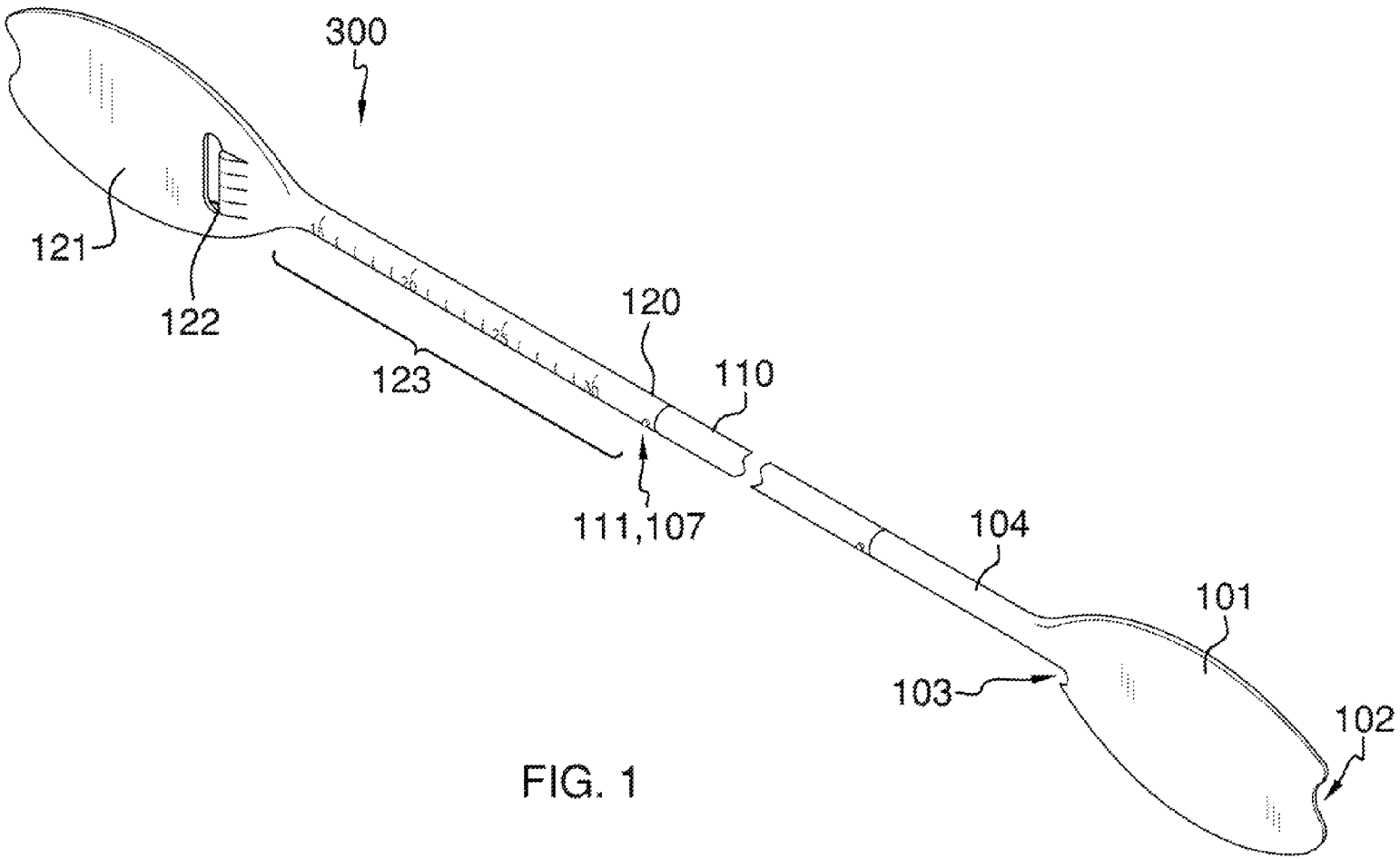
FIG. 1 illustrates a perspective view of the kayak paddle by itself.
Figure 2:
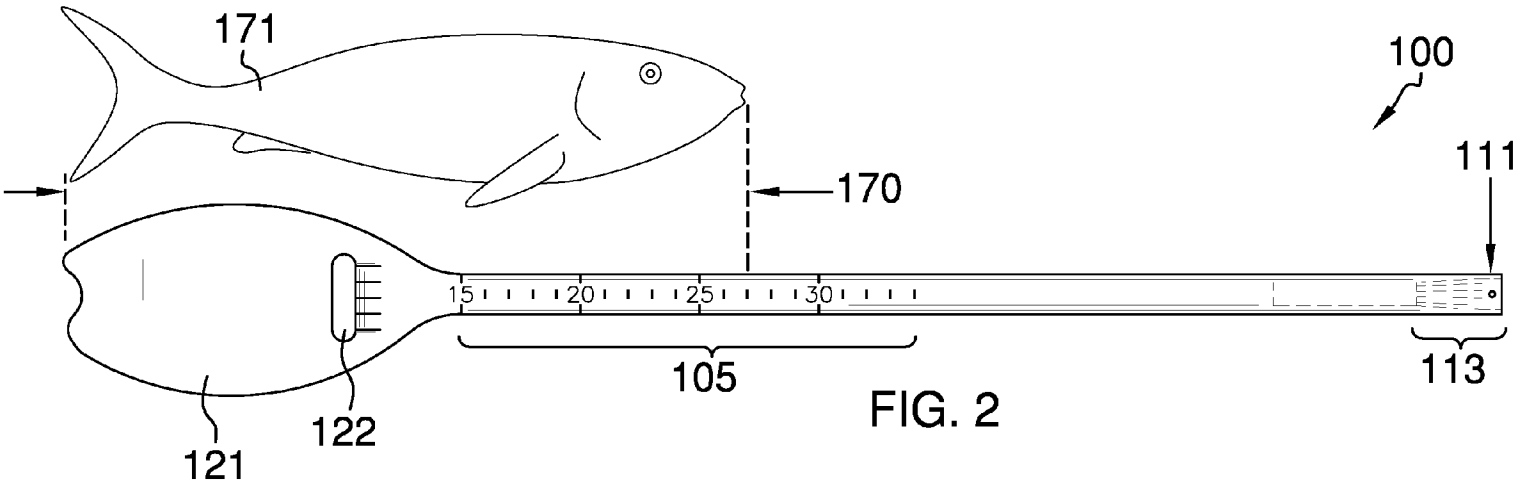
FIG. 2 illustrates a front view of the second paddle blade aligned adjacent to a fish in order to illustrate a measuring of the respective fish via the indentations that are integrated into the second shaft member.
Figure 3:
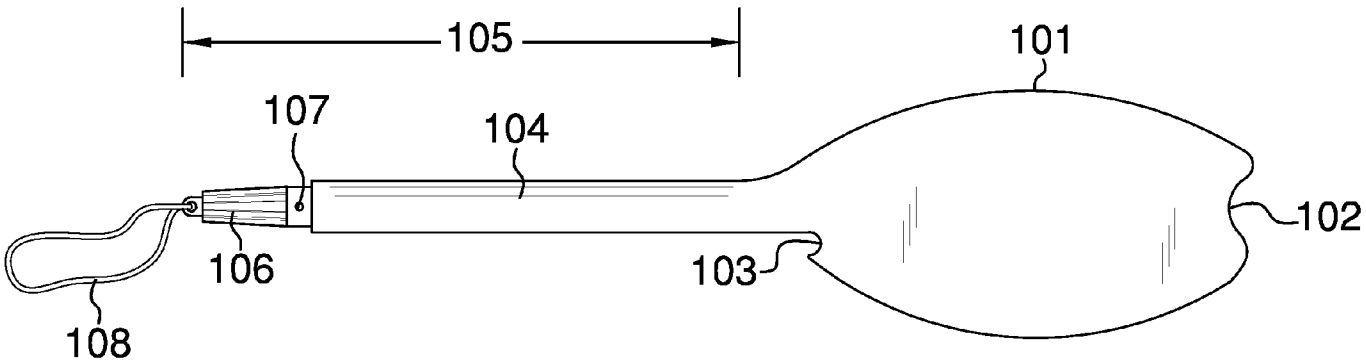
FIG. 3 illustrates a front view of the first paddle blade, the first shaft member, ferrule, and tether.
Figure 3A:
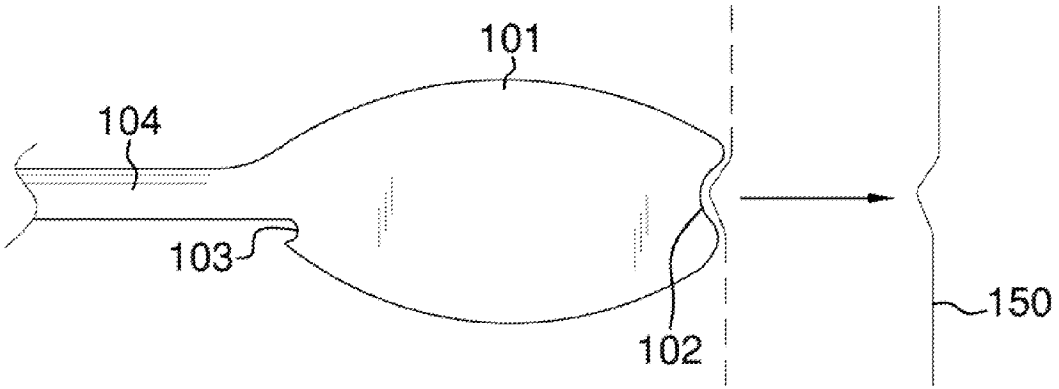
FIG. 3A illustrates a detail of the notched end in use in pushing off of a stationary object.
Figure 3B:
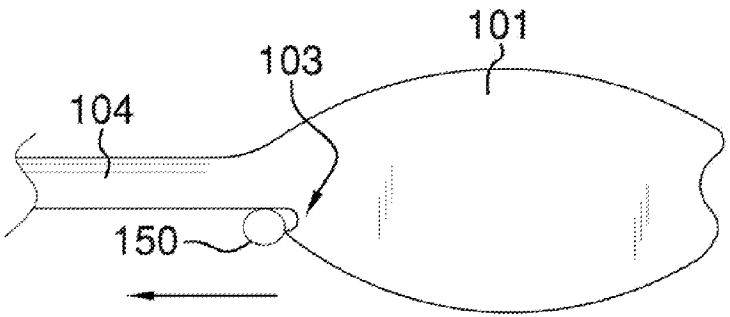
FIG. 3B illustrates a detail of the pull notch in use in pulling towards the stationary object.
Figure 4:
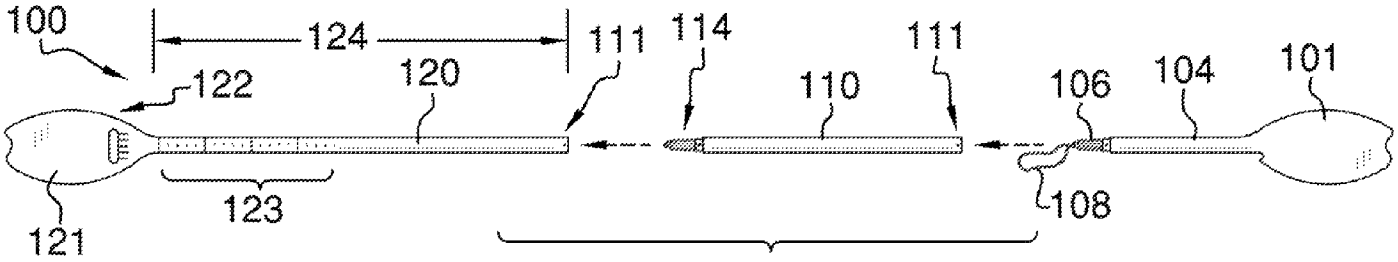
FIG. 4 illustrates an exploded view of all components of the kayak paddle.
Figure 5:
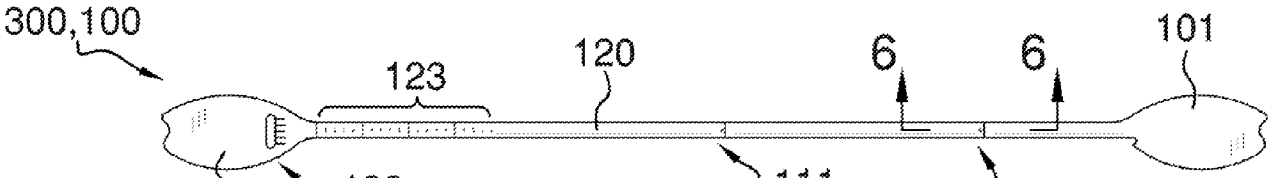
FIG. 5 illustrates a view of all components of the kayak paddle connected in order to form the paddleboard embodiment.

The first paddle blade 101 also includes a pull notch 103 that is located on an opposing end of the first paddle blade 101. The pull notch 103 is oriented opposite of the notched end 102, and is specifically adapted for use in pulling the first paddle blade 101 towards the stationary object 150. In referring to FIGS. 3A-3B, the invention 100 depicts the use of the notched end 102 to push the invention 100 off of and away from the stationary object 150. Conversely, the invention 100 can be used to pull the invention 100 towards the stationary object 150 via the pull notch 103. It shall be further noted that the stationary object 150 may have a different size and shape to reflect the notched end 102 versus the pull notch 103.

The first paddle blade 101 includes a shaft member 104 that extends a pre-defined first length 105, and which includes a ferrule 106 having a spring-loaded button 107 and tether 108. The shaft member 104 and the first paddle blade 101 may be used as an oar, and in a fashion of use associated with paddling a canoe or similar type of watercraft. The ferrule 106 and spring-loaded button 107 enable connection of the shaft member 104 to either an extension shaft 110 or a second shaft member 120. Both the extension shaft 110 and the second shaft member 120 include button holes 111, which enable the spring-loaded button 107 to lock therein.

Figure 6:
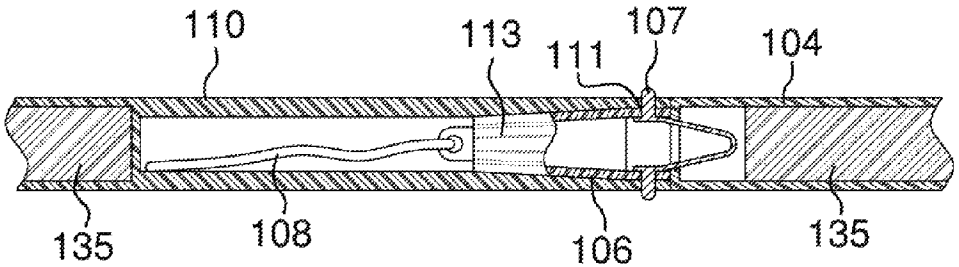
FIG. 6 illustrates a cross-sectional view of the kayak paddle along line 6-6 in FIG. 5, and depicting the spring-loaded button of the ferrule connected to button holes provided on the extension shaft as well as the foam inserts located inside of the respective shafts.
Figure 8:
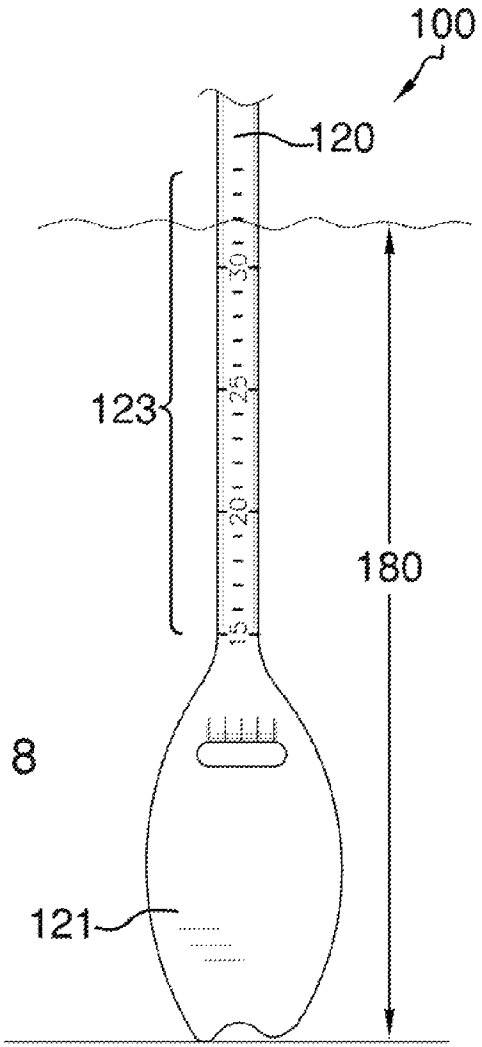
FIG. 8 illustrates a view of the second shaft member being used to determine a water depth.
Figure 7:
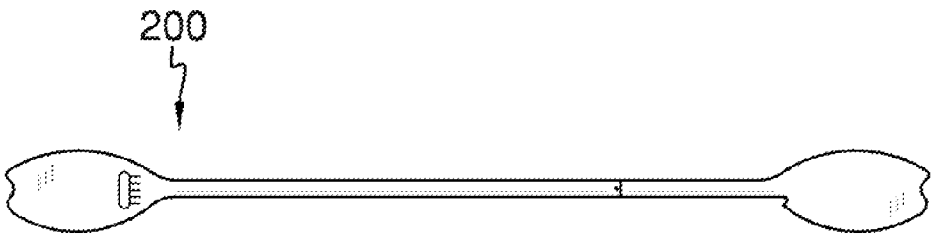
FIG. 7 illustrates a front view of the second shaft member connected to the first shaft member.

Referring to FIGS 4-7, the extension shaft 110 or the second shaft member 120 are able to connect with the shaft member 104 in order to transform the invention 100 into a paddleboard paddle (see FIGS. 1 and 5) or as a kayak paddle 200 (see FIG. 7). It shall be noted that when the invention 100 forms the paddleboard paddle 300 (see FIGS. 1 and 5), the extension shaft 110 connects to both the shaft member 104 and the second shaft member 120. Moreover, the extension shaft 110 is defined with an extension length 112, and includes a ferrule recess 113 for connection with the ferrule 106 of the shaft member 104. The ferrule recess 113 accommodates the ferrule 106 and enables the spring-loaded button 107 to connect with the button holes 111. Moreover, the extension shaft 110 includes an extension ferrule 114 that is on a distal end with respect to the ferrule recess 113.

Referring to FIG. 6, the extension shaft 110, the second shaft member 120, and the shaft member 104 all may include an inner foam core 135, which implies the use of hollowed construction. The inclusion of the inner foam core 135 improves buoyancy as needed.

The second shaft member 120 includes a second paddle blade 121, which is either the same as or similar to the first paddle member 101. The second paddle blade 121 includes a finger grip opening 122 into the center of the second paddle blade 121, which enables an end user to grab the second paddle blade 121 when in use as a paddleboard paddle and/or to use the notched end 102 or pull notch 103 of the first paddle blade 121. The finger grip opening 122 is an elongated circle that enables an end user to insert a plurality of fingers there through in order to grab hold of the second paddle blade 121. It shall be noted that the shape of the finger grip opening 122 is relatively small, and is important in order to minimize a loss in paddling efficiency associated with openings in the surface of the second paddle blade 121.

The second shaft member 120 may include graduations 123 along a second shaft length 124. The graduations 123 indicate a graduation length 125 comprised of a second paddle blade distal end 126 to the respective graduation 123, which forms the graduation length 125. The graduations 123 may be spaced out in 1 inch intervals or involve metric distances, alternatively.

The graduations 123 are included in order to provide a means of measuring different things as needed. For example, an angler may wish to measure a fish length 170 of a caught fish 171 (see FIG. 2). Alternatively, an end user may want to know a water depth 180 (see FIG. 8).

It shall be noted that the first paddle blade 101, the shaft member 104, the extension shaft 110, the second shaft member 120, and the second paddle blade 121 may be made of a plurality of materials. Moreover, the materials may comprise the use of plastic, wood, carbon fiber composite, and other materials associated with oars, paddles, etc.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A kayak paddle comprising:

a first paddle blade and which includes a shaft member thereon;

wherein the first paddle blade may be used as an oar, and be transformed into a said kayak paddle or a paddleboard paddle via use of an extension member and/or second shaft member having a second paddle blade thereon;

wherein the first paddle blade includes a notched end that is located on a distal end, and which enables the first paddle blade to push against a stationary object;

wherein the first paddle blade includes a pull notch that is located on an opposing end of the first paddle blade; wherein the pull notch is oriented opposite of the notched end, and is adapted for use in pulling the first paddle blade towards the stationary object;

wherein the shaft member extends a pre-defined first length from the first paddle blade, and which includes a ferrule having a spring-loaded button and tether; wherein the ferrule and spring-loaded button enable connection of the shaft member to either the extension shaft or the second shaft member; wherein both the extension shaft and the second shaft member include button holes, which enable the spring-loaded button to lock therein;

wherein the second shaft member includes graduations along a second shaft length.

2. The kayak paddle as described in claim 1 wherein the extension shaft connects to both the shaft member and the second shaft member; wherein the extension shaft is defined with an extension length, and includes a ferrule recess for connection with the ferrule of the shaft member; wherein the ferrule recess accommodates the ferrule and enables the spring-loaded button to connect with the button holes.

3. The kayak paddle as described in claim 2 wherein the extension shaft includes an extension ferrule that is on a distal end with respect to the ferrule recess.

4. The kayak paddle as described in claim 1 wherein the extension shaft, the second shaft member, and the shaft member all include an inner foam core.

5. The kayak paddle as described in claim 1 wherein the second paddle blade includes a finger grip opening into the center of the second paddle blade.

6. A kayak paddle comprising:

a first paddle blade and which includes a shaft member thereon;

wherein the first paddle blade may be used as an oar, and be transformed into a said kayak paddle or a paddleboard paddle via use of an extension member and/or second shaft member having a second paddle blade thereon;

wherein the first paddle blade includes a notched end that is located on a distal end, and which enables the first paddle blade to push against a stationary object;

wherein the second paddle blade includes a finger grip opening into the center of the second paddle blade;

wherein the first paddle blade includes a pull notch that is located on an opposing end of the first paddle blade; wherein the pull notch is oriented opposite of the notched end, and is adapted for use in pulling the first paddle blade towards the stationary object;

wherein the shaft member extends a pre-defined first length from the first paddle blade, and which includes a ferrule having a spring-loaded button and tether; wherein the ferrule and spring-loaded button enable connection of the shaft member to either the extension shaft or the second shaft member; wherein both the extension shaft and the second shaft member include button holes, which enable the spring-loaded button to lock therein;

wherein the extension shaft connects to both the shaft member and the second shaft member; wherein the extension shaft is defined with an extension length, and includes a ferrule recess for connection with the ferrule of the shaft member; wherein the ferrule recess accommodates the ferrule and enables the spring-loaded button to connect with the button holes;

wherein the extension shaft includes an extension ferrule that is on a distal end with respect to the ferrule recess;

wherein the extension shaft, the second shaft member, and the shaft member all include an inner foam core;

wherein the second shaft member includes graduations along a second shaft length.

* * * * *